US009718122B2

(12) United States Patent
Mittelstaedt

(10) Patent No.: US 9,718,122 B2
(45) Date of Patent: Aug. 1, 2017

(54) APPARATUS FOR PRODUCING A PISTON

(71) Applicant: Mahle International GmbH, Stuttgart (DE)

(72) Inventor: Michael Mittelstaedt, Boesingen (DE)

(73) Assignee: Mahle International GmbH (DE)

( * ) Notice: Subject to any disclaimer, the term of this patent is extended or adjusted under 35 U.S.C. 154(b) by 169 days.

(21) Appl. No.: 14/687,647

(22) Filed: Apr. 15, 2015

(65) Prior Publication Data

US 2015/0298202 A1 Oct. 22, 2015

(30) Foreign Application Priority Data

Apr. 16, 2014 (DE) ..... 10 2014 207 333

(51) Int. Cl.

| | |
|---|---|
| ***B22C 9/10*** | (2006.01) |
| ***B22C 9/24*** | (2006.01) |
| ***B22D 33/04*** | (2006.01) |
| ***B22C 23/00*** | (2006.01) |

(52) U.S. Cl.

CPC ..... *B22C 9/10* (2013.01); *B22C 9/108* (2013.01); *B22C 23/00* (2013.01)

(58) Field of Classification Search

CPC .. B22C 9/10; B22C 9/108; B22C 9/24; B22C 23/00; B22D 33/04

USPC ..... 164/137, 340, 341

See application file for complete search history.

(56) References Cited

U.S. PATENT DOCUMENTS

| | | | |
|---|---|---|---|
| 3,283,374 A | 11/1966 | Peras | |
| 3,991,811 A | 11/1976 | Diez et al. | |
| 8,770,226 B2 | 7/2014 | Wilen et al. | |
| 8,770,266 B2 * | 7/2014 | Sasaki et al. | B22C 9/10 164/137 |
| 2004/0065430 A1 * | 4/2004 | Whealy et al. | B22D 17/24 164/340 |
| 2010/0018664 A1 * | 1/2010 | Hashimoto et al. | B22C 9/108 164/4.1 |

FOREIGN PATENT DOCUMENTS

| | | | |
|---|---|---|---|
| DE | 1458185 | A1 | 12/1968 |
| DE | 19514400 | C1 | 8/1996 |
| DE | 19701085 | A1 | 7/1998 |
| DE | 19804168 | A1 | 8/1998 |
| DE | 102013206708 | A1 | 10/2013 |

OTHER PUBLICATIONS

English abstract for DE-19514400.
English abstract for DE-19804168.
English abstract for DE19701085.

* cited by examiner

*Primary Examiner* — Kevin P Kerns
(74) *Attorney, Agent, or Firm* — Fishman Stewart PLLC

(57) ABSTRACT

An apparatus for producing a piston may include a casting mold having an axially open cavity defining a surrounding cavity wall, the cavity wall being profiled to receive an annular core to define a cooling duct geometry. A core holding device may be adjustable in an axial direction for introducing the core into the casting mold. The core holding device may include a gripping device for gripping the core. The gripping device may include a plurality of spreadable first grippers. The plurality of first grippers may be adjustable at least between a first position, in which the plurality of first grippers are arranged in a radially inner position, and a second position, in which the plurality of first grippers transition radially outwards in relation to the first position and support the core.

20 Claims, 2 Drawing Sheets

APPARATUS FOR PRODUCING A PISTON

CROSS-REFERENCE TO RELATED APPLICATIONS

This application claims priority to German Patent Application No. 10 2014 207 333.2, filed Apr. 16, 2014, the contents of which are hereby incorporated by reference in their entirety.

TECHNICAL FIELD

The present invention relates to an apparatus for producing a piston for an internal combustion engine by casting. The invention also relates to a method for producing such a piston.

BACKGROUND

On account of increased performance requirements, modern cast pistons, in particular light-alloy pistons, often have a cooling duct, which is produced during the casting by a core, in particular a sand or salt core. After the molten material has solidified, the core is washed out again and thus leaves behind the desired cooling duct. In order also to be able in addition to absorb better the high loads occurring on piston rings, the aforementioned light-alloy pistons often have cast-in ring carriers, in particular of cast iron, in which the later piston ring can be arranged. When fitting such a ring carrier or a salt or sand core in casting moulds for light-alloy pistons, the problem often arises that the ring carrier is the temperature-critical component. There is the risk of internal thermal stresses occurring in the later piston at the interface with the ring carrier. The sand or salt core, on the other hand, is fragile and must be mechanically handled with extreme care. For this reason, previously the core was inserted into the casting mould first and the ring carrier last, before the molten material was introduced. This makes the cooling time for the ring carrier shorter.

The core was often grasped from outside with gripping tongs, the sequence causing a geometrical restriction in that the core inserted first must not protrude into the later path of insertion of the ring carrier. Therefore, above the ring carrier, the core must not under any circumstances reach the inner radius thereof, while at the same height a certain distance must remain as the wall thickness. Only below the ring carrier would there be no constraints. However, there is also increasingly a desire for high-level cooling ducts, for which the salt core overlaps the ring carrier. This makes the placing process of the core and the ring carrier even more complex.

DE 10 2013 206 708 A1 discloses an apparatus of the generic type for producing a piston for an internal combustion engine by casting, the piston containing a cooling duct and the apparatus comprising the following components: a fixed mould with an upwardly open cavity, in which a core serving for forming the cooling duct can be arranged, a movable mould, which is arranged in a vertical direction in relation to the fixed mould and comprises a predetermined engaging part, a guiding mould including an engaging part, which can engage in the fixed mould and has the same form as the engaging part of the movable mould, and also a core holding mechanism, which is arranged in the guiding mould, in order to hold the core, for example a salt or sand core, at a predetermined position. However, a disadvantage of this apparatus is that the mechanically extremely sensitive core is gripped by prestressing from the inside, whereby in particular C-shaped cores, that is to say cores that do not form a closed ring, can break particularly easily.

SUMMARY

The present invention is therefore concerned with the problem of providing for an apparatus of the generic type an improved, or at least alternative, embodiment by means of which even an extremely sensitive core for a cooling duct can be introduced dependably and reliably into a casting mould, without for example thereby hindering the introduction of a ring carrier.

This problem is solved according to the invention by the subject matter of the independent claims. Advantageous embodiments are the subject of the dependent claims.

The present invention is based on the general idea of providing a core holding device with a gripping device that does not subject the core, that is to say for example a salt or sand core, to tensile loading. For this purpose, the apparatus according to the invention has a casting mould with an upwardly open cavity, in which the core lying in such a way as to form a cooling duct can be arranged. The core is introduced into the casting mould by means of the aforementioned core holding device, which has a gripping device with at least three spreadable lower inner grippers. These inner grippers are adjustable between a first position, in which they are arranged radially inwards and in this state can be pushed through the core, and a second position, in which they have been moved radially outwards and, with a radially outwardly facing region, form a support for the core. The inner grippers in this case have in the first position an outside diameter that is smaller than the inside diameter of the core, so that coaxial inward and outward movement is possible. In the expanded state, that is to say in the spread state, the outwardly facing region or projection on the inner grippers goes beyond the inside diameter of the core, so that the latter can without any problem lie thereupon and is then only subjected to its own gravitational force. Radial forces that hold the core by static friction, and thereby additionally subject it to tensile loading, are not exerted in this case. Moments are also not exerted on the core by the gripping device according to the invention. The moment- and tension-free loading of the core means that it is also possible to fit cores that are extremely filigree in comparison with previously.

The gripping device expediently has in addition an upper gripper, which presses the core downwards onto the radially outwardly facing regions of the inner grippers and thereby fixes it. The inner grippers may in this case be formed as L-shaped in cross section, the shorter leg of the L pointing radially outwards and forming the region or projection on which the core can be placed. The optional additional upper gripper makes it possible to be able to clamp the core that is to be fitted between the gripper and the inner grippers, and thereby fix it particularly reliably. The upper gripper also makes it possible to exert a pressure on the core that is directed from above, and as a result to place or fit the core onto sleeves that are arranged in the casting mould. After fitting it on, the inner grippers are adjusted again radially inwards, so that their outside diameter is smaller than the inside diameter of the core and, as a result, the gripping device can be moved upwards out of the casting mould.

Even in their radially moved-out position, the lower inner grippers expediently lie radially within the upper gripper, thereby making it possible for the inner grippers to be passed through coaxially by the gripper.

In the case of a further advantageous embodiment of the solution according to the invention, the apparatus has a ring carrier gripping device, by means of which a ring carrier can be hung in the casting mould. The ring carrier gripping device in this case has radially adjustable gripping arms, which grip the ring carrier from the outside and at the same time fix it. The apparatus is consequently able not only to place into the casting mould a core forming a later cooling duct but also in addition a ring carrier, which is required in particular for the production of light-alloy pistons. In this case, even with the gripping arms adjusted radially inwards, the ring carrier gripping device has a greater inside diameter than the inner grippers and the gripper of the gripping device, thereby making it possible for both the core and the ring carrier to be inserted simultaneously into the casting mould. The simultaneous insertion can in particular reduce the cycle time, and as a result the production costs of the piston can also be reduced.

The inner grippers are expediently arranged in an annular manner and form an inner-lying, at least partially frustoconical surface. In addition, the apparatus has a ram, which is surrounded by the inner grippers and is movable and, on account of contact with the inner-lying, frustoconical surfaces of the inner grippers, radially adjusts and spreads them by moving axially within the inner grippers, the inner grippers being spring-biased into their first position, that is to say into their radially inner-lying position. The axially adjustable ram makes particularly simple moving out or spreading of the inner grippers possible, without further complex mechanisms being required for this. The frustoconical surface inside the inner grippers, which is formed by the total number of inner grippers, consequently brings about a conical narrowing of the inner radius of the radially arranged inner grippers, which inevitably leads to spreading open of the inner grippers if a ram of an outside diameter greater than the smallest inside diameter of the annularly arranged inner grippers is pushed axially through the inner grippers. On account of the fact that the inner grippers are additionally spring-biased into their first position, that is to say against the ram, a return of the inner grippers is also possible comparatively easily, without a complex return mechanism being required for this. Purely theoretically, L-shaped rotatable inner grippers, which in a first position point with their L legs inwards and in a second position point with their L legs outwards, would of course also be conceivable.

In the case of a further advantageous embodiment of the solution according to the invention, a heating device is provided and heats the core and/or the ring carrier directly or indirectly by way of the inner grippers or the gripper of the gripping device or the gripping arms of the ring carrier gripping device. The heating of the core or the ring carrier allows differences in temperature to be minimized, and as a result the casting process to be improved. In particular, as a result, the shock effect on the core during the filling with the molten material can be reduced.

The present invention is also based on the general idea of providing a method for producing a piston by casting with the apparatus described above, in which firstly a core, for example a salt or sand core, is individually provided on a conveying installation. The core holding device takes the core off this conveying installation with its gripping device, in that the radially inwardly adjusted lower inner grippers are first pushed through the core. Subsequently, the inner grippers are moved radially outwards, and thereby form a support for the core. In this state it is possible to remove the core from the conveying installation and for example place it into the casting mould. If the core is to be fitted on sleeves in the casting mould, an upper gripper presses the core against the support of the lower inner grippers when it is being lifted off from the conveying installation, so that the core is clamped between the upper gripper and the inner grippers and is thereby fixed. In this state, the core is placed into the casting mould, whereupon the lower inner grippers are radially moved in. Before or after that, the upper gripper may press the core onto the sleeves arranged in the casting mould, and thereby spear it on them. Subsequently, the gripping device is removed from the casting mould and the piston is cast, for example by filling the mould with molten aluminium.

In the case of an advantageous development of the solution according to the invention, a ring carrier is also placed into the casting mould at the same time as the core, this ring carrier being fixed by means of a ring carrier gripping device and introduced into the casting mould. The gripping device is in this case able to be moved through the ring carrier, since it has an outside diameter that is smaller than the inside diameter of the ring carrier. With the method according to the invention it is possible to handle and place even extremely filigree, and consequently fragile, cores into the casting mould reliably and dependably in terms of the process.

Further important features and advantages of the invention emerge from the subclaims, from the drawings and from the associated description of the figures on the basis of the drawings.

It goes without saying that the aforementioned features and the features still to be explained below can be used not only in the respectively specified combination, but also in other combinations or on their own without departing from the scope of the present invention.

Preferred exemplary embodiments of the invention are represented in the drawings and are explained in more detail in the description that follows, the same reference numerals referring to components that are the same or similar or are functionally the same.

DETAILED DESCRIPTION

Figure 1:
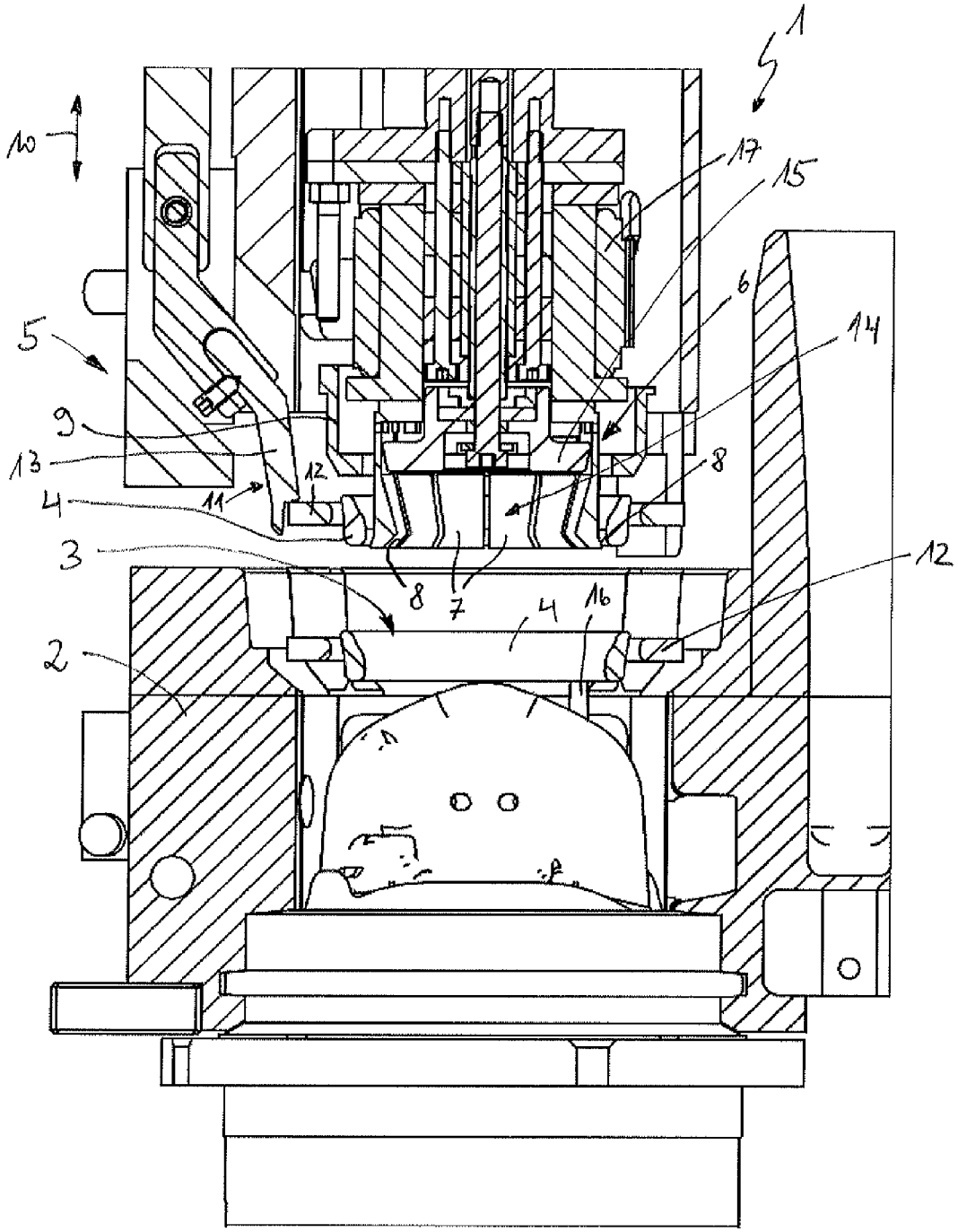
FIG. 1 schematically shows a sectional representation through an apparatus according to the invention for producing a piston for an internal combustion engine by casting, FIG. 2 schematically shows a representation of a detail from FIG. 1 in the region of a core holding device.

As shown in FIG. 1, the apparatus 1 for producing a piston for an internal combustion engine by casting has a casting mould 2 with an upwardly open cavity 3, in which a core 4, for example a salt core or a sand core, lying in such a way as to form a cooling duct can be arranged. Likewise provided is a core holding device 5 for introducing the core 4 into the casting mould 2 (cf. in particular FIG. 2). According to the invention, the core holding device 5 has a gripping device 6 with spreadable lower inner grippers 7, which are adjustable between a first position, in which they are arranged radially inwards and in this state can be pushed through the core 4, and a second position, in which they have been moved radially outwards and, with a radially outwardly facing region 8, form a support for the core 4. The region 8 is in this case formed in the manner of a projection. In their first position, the inner grippers 7 have an outside diameter that is smaller than the inside diameter of the core 4, so that the inner grippers 7 can be moved through the core 4.

With the gripping device 6 according to the invention and its inner grippers 7 it is possible for the first time to grip a core 4, in particular a core that is sensitive to tensile stress, from the inside without it being clamped from the inside and thereby subjected to tensile loading. In addition to the inner grippers 7, the gripping device 6 also has an upper gripper 9, which presses the core 4 downwards onto the radially outwardly facing regions 8 of the inner grippers 7 and thereby fixes it. According to FIGS. 1 and 2, the inner grippers 7 are in this case in their first, that is to say not radially moved-out position, and the upper gripper 9 is still not in contact with the core 4. The upper gripper 9 has an annular shape and can be adjusted in the axial direction 10. Even in their radially moved-out position, the lower inner grippers 7 lie radially within the upper gripper 9, so that the outside diameter of the inner grippers 7 is in any event smaller than the inside diameter of the gripper 9, whereby passing through of the inner grippers 7 by the gripper 9 is possible in every state.

Figure 2:
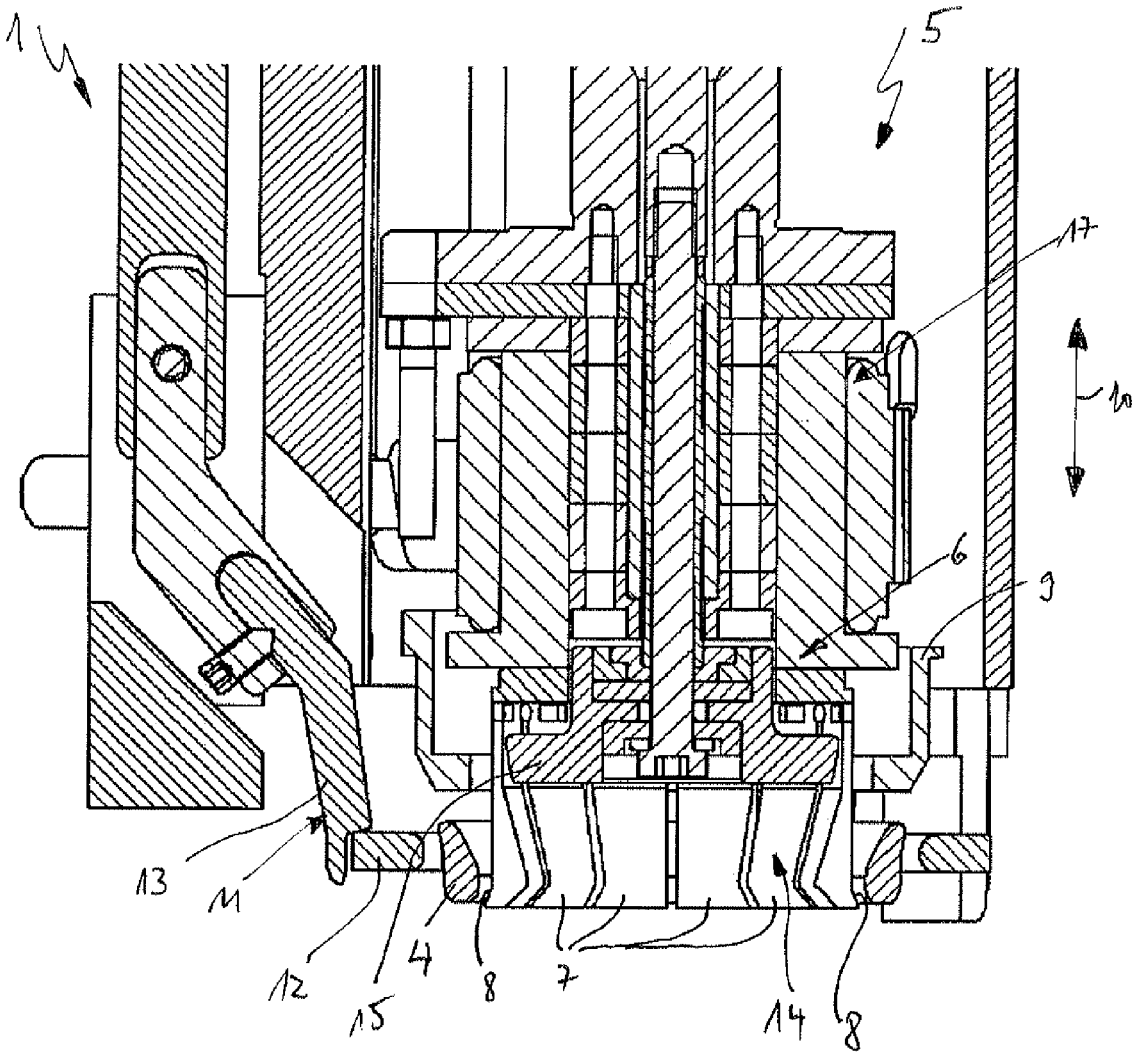

The apparatus 1 expediently also has in addition a ring carrier gripping device 11, by means of which a ring carrier 12 can be introduced into the casting mould 2. The ring carrier 12 serves in this case for the mounting of a piston ring on the finished cast piston. The ring carrier gripping device 11 has in this case radially adjustable gripping arms 13, which according to FIGS. 1 and 2 are formed as clamping fingers and grip the ring carrier 12 from the outside and fix it. Even with the gripping arms 13 adjusted radially inwards, the ring carrier gripping device 11 has a greater inner radius than the inner grippers 7 and the gripper 9 of the gripping device 6, so that at least partial passing of the gripping device 6 through the ring carrier gripping device 11 is possible. The gripping device 6 preferably also has an outside diameter that is smaller than the inside diameter of the ring carrier 12, at least in a certain axial region, thereby making it possible for both the core 4 and the ring carrier 12 to be inserted simultaneously into the casting mould 2.

If the gripping device 6 is considered more closely, it can be seen that the inner grippers 7 of the same are arranged in an annular manner and form an inner-lying, at least partially frustoconical surface 14 (cf. FIG. 2). Likewise provided is a ram 15, which is surrounded by the inner grippers 7 in an annular manner and is movable and, on account of contact with the inner-lying, frustoconical surface 14 of the inner grippers 7, radially adjusts and spreads them by moving axially within the inner grippers 7, and thereby adjusts them into their second position. A return of the inner grippers 7 can take place by them being spring-biased into their first position, and consequently held in their second position exclusively by means of the ram 15. If the ram 15 is moved upwards, as is shown according to FIGS. 1 and 2, it is no longer in contact with the frustoconical surface 14 formed by the inner contours of the inner grippers 7, whereupon the latter resume their radially inner-lying, and consequently first position as a result of their spring biasing.

If FIG. 1 is considered once again, it can be seen in it that at least two sleeves 16 are arranged on the casting mould 2, one of which is visible, and on which the core 4 can be placed or fitted. The fitting of the core 4 onto the sleeve 16 takes place in this case by exerting a pressure by means of the gripper 9.

In the case of a further advantageous embodiment of the solution according to the invention, a heating device 17 is also provided in addition and heats the core 4 and/or the ring carrier 12 directly or indirectly by way of the inner grippers 7 or the gripper 9 of the gripping device 6 or the gripping arms 13 of the ring carrier gripping device 11. This makes it possible in particular to minimize differences in temperature that influence or even impair the production process.

The present invention is also based on the general idea of introducing the core 4 into a casting mould 2 by means of such an apparatus 1 or a core holding device 5 without thereby exerting tensile stresses or moments on the core 4. For this purpose, first the lower inner grippers 7 are adjusted into their first position, and consequently radially inwards, whereupon the inner grippers 7 can be pushed through the core 4, since their outside diameter is smaller than the inside diameter of the core 4. Once this has happened, the inner grippers 7 are moved radially outwards, in that the ram 15 is moved downwards and thereby spreads the inner grippers 7 over the frustoconical surface 14. In this second position, the regions 8 of the inner grippers 7 form a support for the core 4. Subsequently, the upper gripper 9 presses the core 4 against the lower inner grippers 7 and thereby fixes it. In this state, the core 4 can be placed into the casting mould 2. The lower inner grippers 7 can then be moved in radially, that is to say moved back into their first position, in that the ram 15 is adjusted upwards and the inner grippers 7 move in on account of their spring biasing. The upper gripper 9 subsequently presses the core 4 onto the sleeves 16 arranged in the casting mould 2, whereupon the gripping device 6 is subsequently removed from the casting mould 2. A ring carrier 12 may also be placed into the casting mould 2 at the same time as the core 4 by means of the ring carrier gripping device 11, it being possible for the gripping device 6 to be moved through the ring carrier 12.

By means of the apparatus 1 according to the invention it is possible for the first time not to subject the core 4 that is to be placed in to tensile loading either from the outside or from the inside, but merely to push inner grippers 7 through it, then expand the grippers under it and thus support it on a resultant contour (regions 8). Subsequently, it is pressed from above by the gripper 9 onto the regions 8 of the moved-out inner grippers 7 (by means of low force) and thereby fixed. After that or at the same time, it is also possible to place the ring carrier 12 into the casting mould by means of the ring carrier gripping device 11. This makes it possible for the first time also to be able to position cores 4 above a ring carrier 12, and overlapping with it in the placing-in direction (axial direction 10). This is only possible if the ring carrier 12 is placed in before or at the same time as the core 4. This, however, is only possible if the core 4 can be gripped from the inside, which however was not previously possible on account of the fragility of the core 4 and the tensile stresses applied in the case of conventional inner grippers. By means of the apparatus 1 according to the invention it is in particular also possible to position the temperature-critical component, that is the ring carrier 12, below or at the same height as the core 4, which was not previously possible on account of the defined positional sequence (core 4 below and ring carrier 12 above).

The invention claimed is:

1. An apparatus for producing a piston, comprising:

a casting mould with an axially open cavity defining a surrounding cavity wall, the cavity wall being profiled to receive an annular core to define a cooling duct geometry;

a core holding device adjustable in an axial direction for introducing the core into the casting mould, wherein the core holding device includes a gripping device including a plurality of spreadable first grippers defining a plurality of associated mounting regions respectively facing radially towards the cavity wall, the plurality of first grippers being adjustable at least between a first position, in which the plurality of first grippers are arranged in a radially innermost position and define a diameter less than the core, and a second position, in which the plurality of first grippers transition radially outwards in relation to the first position and support the core via the plurality of associated mounting regions; and at least one of:

a ring carrier gripping device coordinated with the core holding device to introduce a ring carrier into the casting mould; and a ram arranged coaxial to the plurality of first grippers, the ram being axially adjustable to engage a radially inner surface defined by the plurality of first grippers, wherein the plurality of first grippers respectively transition to the second position in response to the ram engaging the inner surface.

2. The apparatus according to claim 1, wherein the gripping device further includes at least one second gripper arranged coaxial to and axially spaced apart from the plurality of first grippers, the at least one second gripper adjustable to advance the core in a direction towards the plurality of associated mounting regions of the plurality of first grippers to mount the core between the plurality of first grippers and the at least one second gripper.

3. The apparatus according to claim 1, wherein the ram is provided and coupled to the core holding device.

4. The apparatus according to claim 1, wherein the ring carrier gripping device is provided and includes at least one radially adjustable gripping arm mounting the ring carrier.

5. The apparatus according to claim 4, wherein the at least one gripping arm is adjustable at least between a first position, in which the ring carrier is in a radially inner position, and a second position, in which the ring carrier is in a radially outer position in relation to the first position, the ring carrier of the ring carrier gripping device having a greater inner radius in the first position than the plurality of first grippers and the at least one second gripper of the gripping device.

6. The apparatus according to claim 1, wherein:

the ram is arranged coaxial to the plurality of first grippers;

the plurality of first grippers are annularly arranged in relation to one another and are coordinated with each other such that the plurality of first grippers together define an at least partially frustoconical surface along the radially inner surface in the first position; and the ram is axially adjustable to engage the at least partially frustoconical surface and move the plurality of first grippers from the first position to the second position.

7. The apparatus according to claim 6, wherein the plurality of first grippers are spring-biased and transition to the first position in response to the ram disengaging the frustoconical surface.

8. The apparatus according to claim 1, wherein the casting mould includes at least two sleeves arranged to receive the core.

9. The apparatus according to claim 1, further comprising a heating device coordinated with the core holding device to heat at least one of the core and the ring carrier.

10. A method for producing a piston comprising the steps of:

providing a casting mould having an axially open cavity defining a surrounding cavity wall;

inserting a plurality of radially adjustable first grippers coordinated in a first position through an annular core, wherein the plurality of first grippers define a diameter less than a diameter of the core;

adjusting the plurality of first grippers radially in a direction towards the core to a second position and engaging the core via a plurality of mounting regions associated with the plurality of first grippers, wherein the core rests on the plurality of mounting regions;

mounting the core on a side opposite the plurality of mounting regions via an axially adjustable second gripper and supporting the core with the second gripper against the plurality of first grippers;

positioning the core into the casting mould;

retracting the plurality of first grippers radially to the first position; and pressing the core via the second gripper onto at least one supporting sleeve arranged in the casting mould.

11. The method according to claim 10, wherein positioning the core into the casting mould further includes arranging a ring carrier into the casting mould.

12. The method according to claim 11, wherein the ring carrier has a greater inner radius than the plurality of first grippers and the second gripper, and wherein arranging the ring carrier into the casting mould includes inserting at least one of the plurality of first grippers and the second gripper through the ring carrier.

13. The method according to claim 10, wherein adjusting the plurality of first grippers radially in the direction towards the core to the second position includes moving a ram axially to engage a radially inner surface of the plurality of first grippers.

14. An apparatus for producing a piston, comprising:

a core holding device for introducing a core into a casting mould, the core holding device defining a longitudinal center axis and being adjustable in an axial direction along the longitudinal center axis;

a gripping device coupled to the core holding device for gripping the core, the gripping device including:

a plurality of first grippers adjustable in a radial direction and defining a plurality of associated mounting regions for supporting a first side of the core, the plurality of mounting regions respectively facing away from the longitudinal center axis, wherein the plurality of first grippers are radially adjustable at least between a first position, in which the plurality of first grippers are arranged in a radially innermost position, and a second position, in which the plurality of first grippers transition radially outwards in relation to the first position and engage the first side of the core via the plurality of associated mounting regions; and at least one second gripper arranged coaxial to the plurality of first grippers and axially spaced from the same, wherein the at least one second gripper is axially adjustable to engage a second side of the core opposite the first side and advance the core in a direction towards the plurality of mounting regions to support the core between the plurality of first grippers and the at least one second gripper in the second position.

15. The apparatus according to claim 14, further comprising a heating device coordinated with the core holding device to heat the core.

16. The apparatus according to claim 14, wherein the plurality of first grippers are annularly arranged in relation to one another and are coordinated to define a radially inner at least partially frustoconical surface in the first position.

17. The apparatus according to claim 14, wherein the plurality of mounting regions of the plurality of first grippers define an outer perimeter having a radial extent less than a radial extent of an inner perimeter defined by the at least one second gripper in the first position and the second position.

18. The apparatus according to claim 14, wherein the plurality of first grippers are spring-biased into the first position.

19. The apparatus according to claim 14, wherein the plurality of mounting regions are respectively structured as a projection.

20. The apparatus according to claim 14, wherein the casting mould is arranged along the longitudinal axis of the core holding device and has an axially open cavity for receiving the core.

* * * * *